US007918059B2

(12) United States Patent
Repasky

(10) Patent No.: US 7,918,059 B2
(45) Date of Patent: Apr. 5, 2011

(54) PEDESTAL FOR BALLAST BLOCK DECKING

(76) Inventor: John Repasky, Hanover, PA (US)

( * ) Notice: Subject to any disclaimer, the term of this patent is extended or adjusted under 35 U.S.C. 154(b) by 7 days.

(21) Appl. No.: 12/417,927

(22) Filed: Apr. 3, 2009

(65) Prior Publication Data

US 2009/0183442 A1 Jul. 23, 2009

Related U.S. Application Data

(63) Continuation of application No. 11/555,716, filed on Nov. 2, 2006, now abandoned.

(51) Int. Cl.
*E04B 5/00* (2006.01)

(52) U.S. Cl. ..... 52/263; 52/126.4; 52/126.6

(58) Field of Classification Search ..... 52/263, 52/126.1, 126.4, 126.5, 126.6, 126.7
See application file for complete search history.

(56) References Cited

U.S. PATENT DOCUMENTS

| | | | | | |
|---|---|---|---|---|---|
| 4,085,557 | A | | 4/1978 | Tharp | |
| 4,277,923 | A | | 7/1981 | Rebentisch et al. | |
| 4,558,544 | A | * | 12/1985 | Albrecht et al. | 52/126.6 |
| 4,570,397 | A | | 2/1986 | Creske | |
| 4,759,162 | A | * | 7/1988 | Wyse | 52/126.6 |
| 4,996,804 | A | | 3/1991 | Naka et al. | |
| 5,333,423 | A | | 8/1994 | Propst | |
| 5,377,468 | A | | 1/1995 | Repasky | |
| 5,442,882 | A | | 8/1995 | Repasky | |
| 5,588,264 | A | * | 12/1996 | Buzon | 52/126.6 |
| 5,862,635 | A | * | 1/1999 | Linse et al. | 52/126.6 |
| 6,332,292 | B1 | * | 12/2001 | Buzon | 52/126.6 |
| 6,363,685 | B1 | * | 4/2002 | Kugler | 52/745.05 |
| 6,520,471 | B2 | * | 2/2003 | Jones et al. | 248/346.5 |
| 6,604,330 | B2 | | 8/2003 | Repasky | |
| 2002/0078638 | A1 | * | 6/2002 | Huang | 52/126.6 |
| 2002/0148173 | A1 | * | 10/2002 | Kugler | 52/126.6 |
| 2004/0035064 | A1 | * | 2/2004 | Kugler et al. | 52/126.6 |
| 2004/0074170 | A1 | * | 4/2004 | Huang | 52/220.1 |
| 2004/0261325 | A1 | * | 12/2004 | Glynos | 52/4 |
| 2008/0053017 | A1 | | 3/2008 | Hockemeyer et al. | |
| 2008/0053018 | A1 | | 3/2008 | Hockemeyer et al. | |
| 2008/0222973 | A1 | | 9/2008 | Lee et al. | |

OTHER PUBLICATIONS

Bison, "Bison Deck Supports ScrewJack B-Series Specifications", pp. 1-4, Oct. 6, 2005.
Bison, "Bison ScrewJack B Series Pedestals", pp. 1-2, Sep. 30, 2005.
Elmich, "VersiJack", 9 pages, Oct. 9, 2006.

(Continued)

*Primary Examiner* — Brian E Glessner
*Assistant Examiner* — Jessica Laux
(74) *Attorney, Agent, or Firm* — Barley Snyder LLC

(57) ABSTRACT

A deck system and pedestal for use in forming an elevated surface are provided. The pedestal for supports blocks, pavers, tiles, or panels a spaced distance above an underlying surface. The pedestal has a base, a reinforcement wall, a support, and a coupler with a flange. The base is at a lower end of the pedestal and has a plate extending outward from a post. The reinforcement wall extends between the plate and the post and has a first eyelet formed therein. The support is located at an upper end of the pedestal for supporting the blocks, pavers, tiles, or panels thereon. It is adjustably mounted relative to the base for altering an overall height of the pedestal. The coupler, having a flange is adjustably located between the support and the base for further altering the overall height of the pedestal. A plurality of spaced-apart second eyelets extend through the flange.

9 Claims, 4 Drawing Sheets

OTHER PUBLICATIONS

Wausau Tile, "Pedestal/Roof Deck System Components", (http://www.wausautile.com/paving/pedestal RoofDeckSystems.cfm) Apr. 3, 2009 .

Wausau Tile, "Terra System One Level Installation, Terr-Adjust System", (http://www.wausautile.com), Apr. 3, 2009.

Wausau Tile, "Terra System One Level Installation, Terra-Stand System", (http://www.wausautile.com), Apr. 3, 2009.

Westile, "Pedestals", (http://www.westile.com/pedestal.asp?img=13&cat×comm&ped=acc) Apr. 3, 2009.

Westile, "ScrewJack Pedestals", (http://www.westile.com), Dec. 2006.

* cited by examiner

PEDESTAL FOR BALLAST BLOCK DECKING

RELATED APPLICATION DATA

This application is continuation application of application Ser. No. 11/555,716 filed on Nov. 2, 2006 now abandoned.

FIELD OF THE INVENTION

The present invention relates generally to a deck systems for use in constructing an elevated traffic-bearing surface, such as on the roof of a building, and more particularly, the present invention relates to a height-adjustable pedestal and deck system using same.

BACKGROUND

Roof structures of many buildings are capable of supporting a substantially horizontal surface, or deck, enabling the construction of roof terraces, pedestrian walkways, roof gardens, plaza decks, sun decks, balconies, patios or the like. Such roof surfaces are often formed at a slight slope relative to horizontal for drainage purposes. Typically, the roof surface itself is not constructed of a material that provides a suitable traffic bearing surface nor is it aesthetically pleasing.

Examples of deck systems utilizing roof pavers, or ballast blocks, are disclosed by U.S. Pat. Nos. 5,887,397; 5,377,468; 5,442,882; and 6,604,330 B2 issued to Repasky. Also see U.S. Pat. Nos. 4,570,397 issued to Creske; and 5,588,264 and 6,332,292 B1 issued to Buzon.

While the rooftop ballast block deck systems disclosed in the above referenced patents may be satisfactory for their intended purposes, there is a need for a stable, readily adjustable pedestal for use in such systems. The system should permit proper drainage, for instance to an underlying roof surface, and should enable ready installation of bracing between adjacent pedestals. In addition, the pedestals should be capable of efficient manufacture and installation.

SUMMARY

More specifically, the present invention is a pedestal for supporting blocks, pavers, tiles, or panels a spaced distance above an underlying surface. The pedestal has a base, a reinforcement wall, a support, and a coupler with a flange. The base is at a lower end of the pedestal and has a plate extending outward from a post. The reinforcement wall extends between the plate and the post and has a first eyelet formed therein. The support is located at an upper end of the pedestal for supporting the blocks, pavers, tiles, or panels thereon. It is adjustably mounted relative to the base for altering an overall height of the pedestal. The coupler, having a flange is adjustably located between the support and the base for further altering the overall height of the pedestal. A plurality of spaced-apart second eyelets extend through the flange.

According to some of the embodiments of the present invention, the support can include a support plate. The upper surface of the support plate can be provided with a surface that secures and stabilizes the block, paver, or panel on the pedestal. As an example, the surface can be provided by a rubber pad, coating, texture or the like applied to the upper surface. The pad, coating, texture or the like can be used to deaden noise, absorb shock, and increase friction between the pedestal and the block, paver, or panel. If a rubber pad is used, it can be mechanically snapped onto the support plate with cooperating bosses and recesses formed in engaging surfaces of the pad and support plate.

BRIEF DESCRIPTION OF THE DRAWINGS

The features and advantages of the present invention should become apparent from the following description when taken in conjunction with the accompanying drawings, in which.

DETAILED DESCRIPTION OF THE EMBODIMENTS

Figure 1:
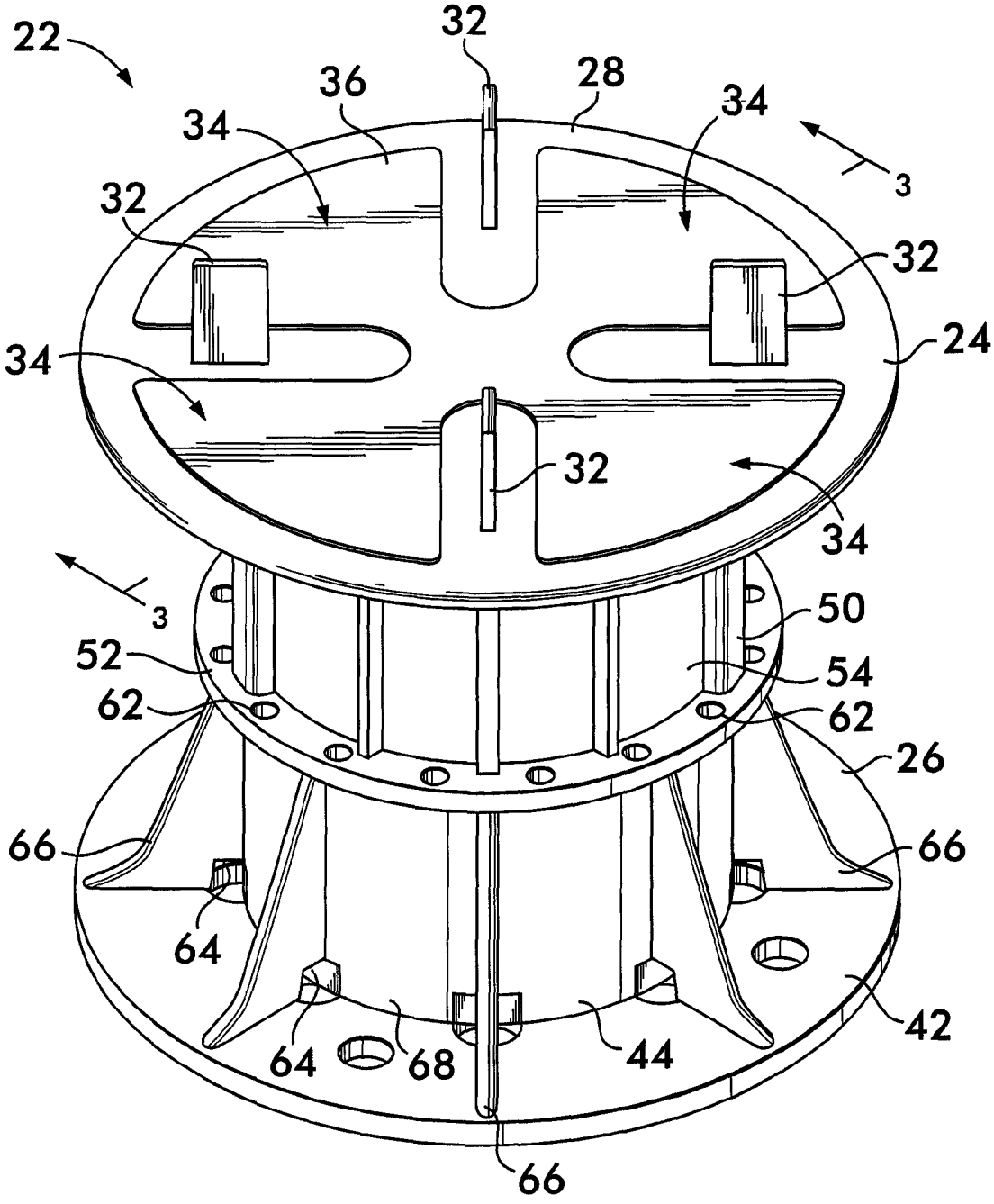
FIG. 1 is a perspective view of a pedestal embodying the present invention.

Referring now to the drawings, a deck 10 is constructed of a plurality of separate, substantially-rectangular pavers, ballast blocks, or panels 12 (hereinafter referred to as blocks) that are arranged in a grid layout, or pattern, and that are supported a spaced distance above a surface, such as an exterior roof surface 14 of a building. The deck 10 provides a substantially level traffic-bearing surface 16 for pedestrians and an aesthetic appearance. It can be used to convert an otherwise unusable rooftop or like space into a useful area.

Each block 12 can be made of concrete, marble, granite, wood, rubber, plastic, composite materials, or like weight-bearing substance and is typically square, rectangle, or some other shape that can be positioned in uniform patterns. Thus, each block 12 will typically have corner portions 18, and the deck 10 will have intersection areas 20 in which corner portions 18 of adjacent blocks 12 extend. A separate pedestal 22 underlies each intersection area 20 and supports the corner portions 18 of the adjacent ballast blocks 12. Thus, the entire deck 10 is elevated from an underlying structure, such as exterior roof surface 14. The spacing provided between the blocks 12 and surface 14 and between the laterally positioned blocks 12 permits proper drainage of fluids, such as rain, through the deck 10.

Figure 2:
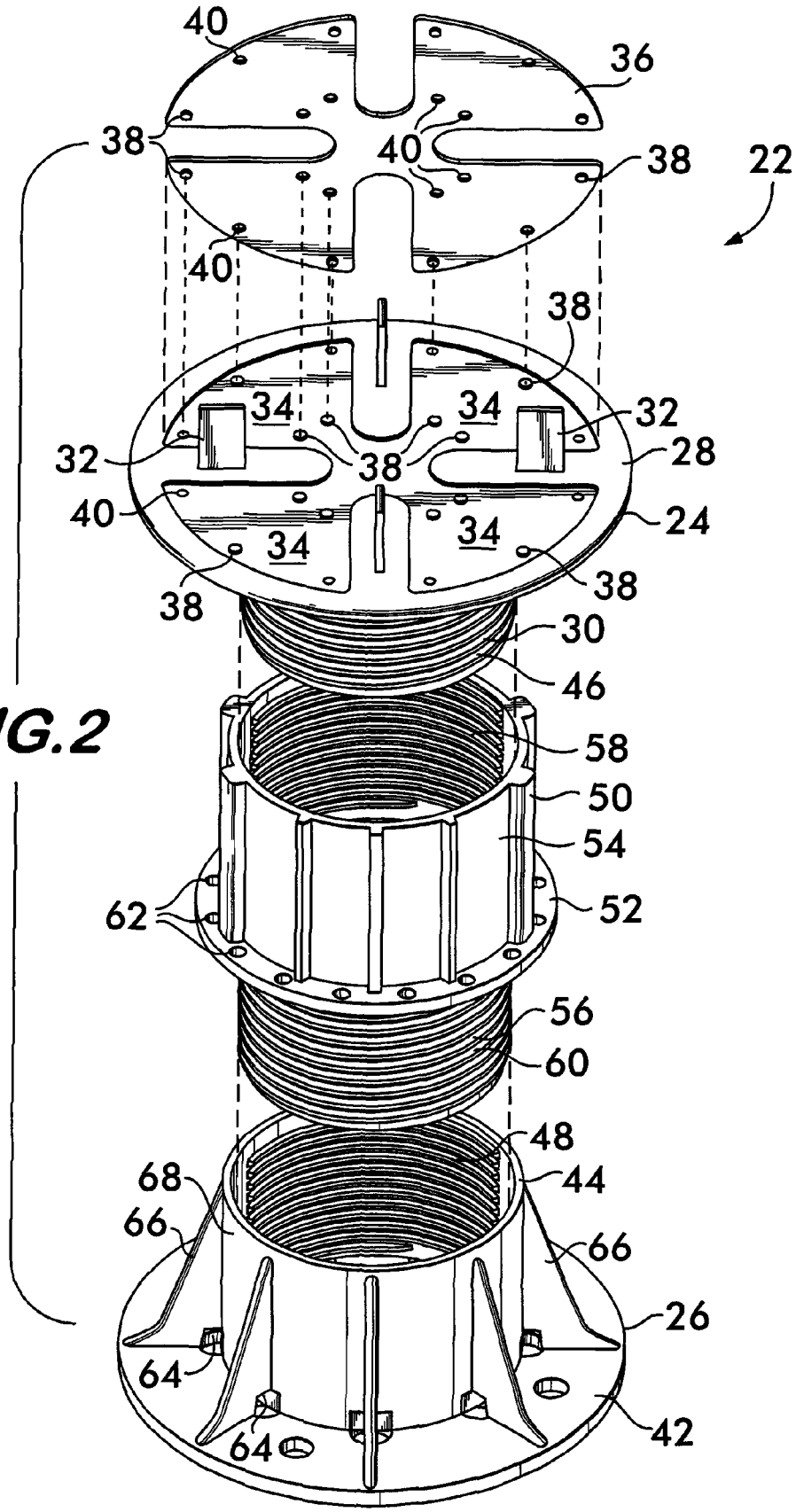
FIG. 2 is an exploded perspective view of the pedestal of FIG. 1.

As best illustrated in FIG. 2, each pedestal 22 includes a support 24 at an upper end thereof and a base 26 at a lower end thereof. The presence of an intermediate coupler 50, as shown in FIG. 2, is optional. In its simplest form, the pedestal 22 can consist solely of the support 24 and base 26 without an intermediate coupler 50. The support 24 and base 26 are preferably manufactured separately and are molded of plastic. The support 24 and base 26 interconnect in a manner permitting an overall height "H" of the pedestal 22 to be adjusted. More specifically, the action of rotating the support 24 relative to the base 26 causes the height "H" of the pedestal 22 to be altered. Thus, the height "H" of each pedestal 22 in the deck 10 can be readily adjusted, as required, during installation of the deck 10 and/or during maintenance thereof.

In the illustrated embodiment, the support 24 includes a plate 28 with a substantially cylindrical post 30 depending therefrom. In use, the plate 28 is disposed in a substantially horizontal position thereby providing a surface on which the corner portions 18 of the blocks 12 can be supported. Preferably, a plurality of upstanding walls 32 project from the plate 28 and define separate quadrants 34 on the plate 28. Each quadrant 34 receives one corner portion 18 of a block 12. The walls 32 align the corner portions 18 on the pedestal 22 and define lateral spacing between adjacent blocks 12 to permit rain water and other fluids to drain through the deck 10 and around the outside of plate 28.

The upper surface of the plate 28 is provided with a surface that secures and stabilizes the block, paver, or panel on the pedestal 22. This surface functions to prevent and/or deaden noise that may otherwise be created when pedestrians walk on the blocks, pavers, or panels. In addition, the surface can provide a shock absorbing function and can increase friction between the block, paver, or panel and the pedestal 22. As an example, the surface can be provided by a pad 36 or by a coating, texture, or the like applied to an upper surface of the plate 28.

If a separately manufactured pad 36 is used, it can be made of rubber, an elastomeric material, or like material and secured on the upper surface of the plate 28. The rubber pad 36 deadens any noise that may otherwise be generated due to any slight movement between the contacting surfaces of the pedestal 22 and block 12 such as when pedestrians walk on the block. The pad 36 also increases friction between the block 12 and the pedestal 22 and can prevent damage to the upper surface of the pedestal 22 from placement of the block 12 thereon. The pad 36 can be provided as single pad or as multiple separate strips or sections.

The pad 36 can be mechanically and/or adhesively secured to the plate 28. For example, the engaging surfaces of the pad 36 and plate 28 can include a plurality of bosses 38 and recesses 40 that cooperate to provide a snap-fit connection. An adhesive can be applied between the surfaces before snap fitting the pad 36 to the plate 28.

In the illustrated embodiment, the base 26 includes a plate 42 with a substantially cylindrical, hollow post 44 projecting therefrom. In use, the plate 42 is disposed in a substantially horizontal position and the post 30 of the support 24 is received therein. Preferably, spiral threads 46 are located on an external surface of the post 30 of the support 24 and cooperating spiral threads 48 are located on the internal surface of the hollow post 44 of the base 26. The cooperating threads, 46 and 48, are sized to engage each other and permit the support 24 to be screwed into the base 26. The threads, 46 and 48, can be continuous or discontinuous. Rotation of the support 24 relative to the base 26 enables the overall height "H" of the pedestal 22 to be continuously adjustable. As an alternative arrangement, the post of the support can receive the post of the base, and the positioning of the threads can be reversed such that the support has internal threads and the base has external threads.

Figure 3:
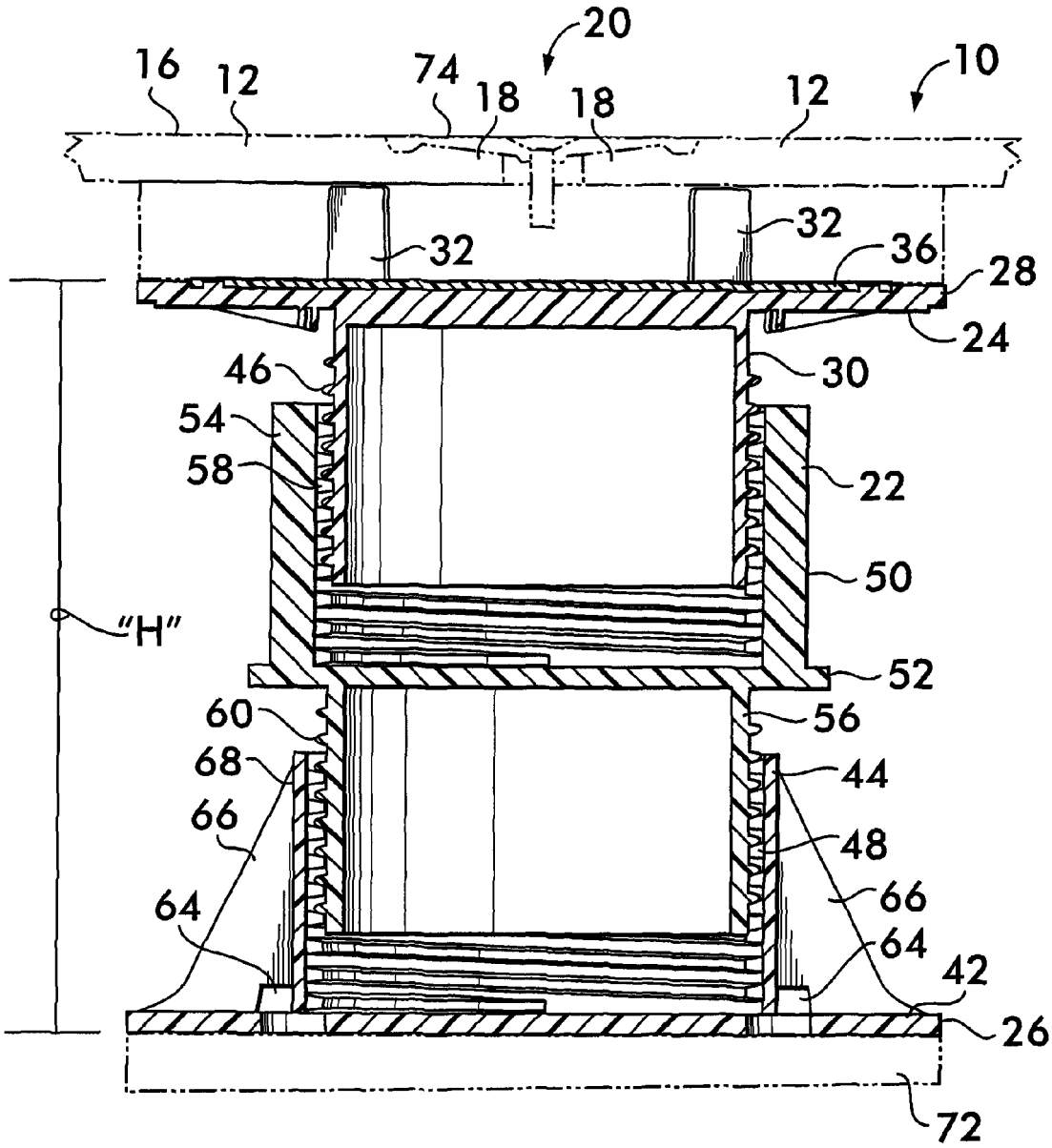
FIG. 3 is a cross-sectional elevational view of the pedestal of FIG. 1 in use with a leveler and tie down device to support pavers.
Figure 4:
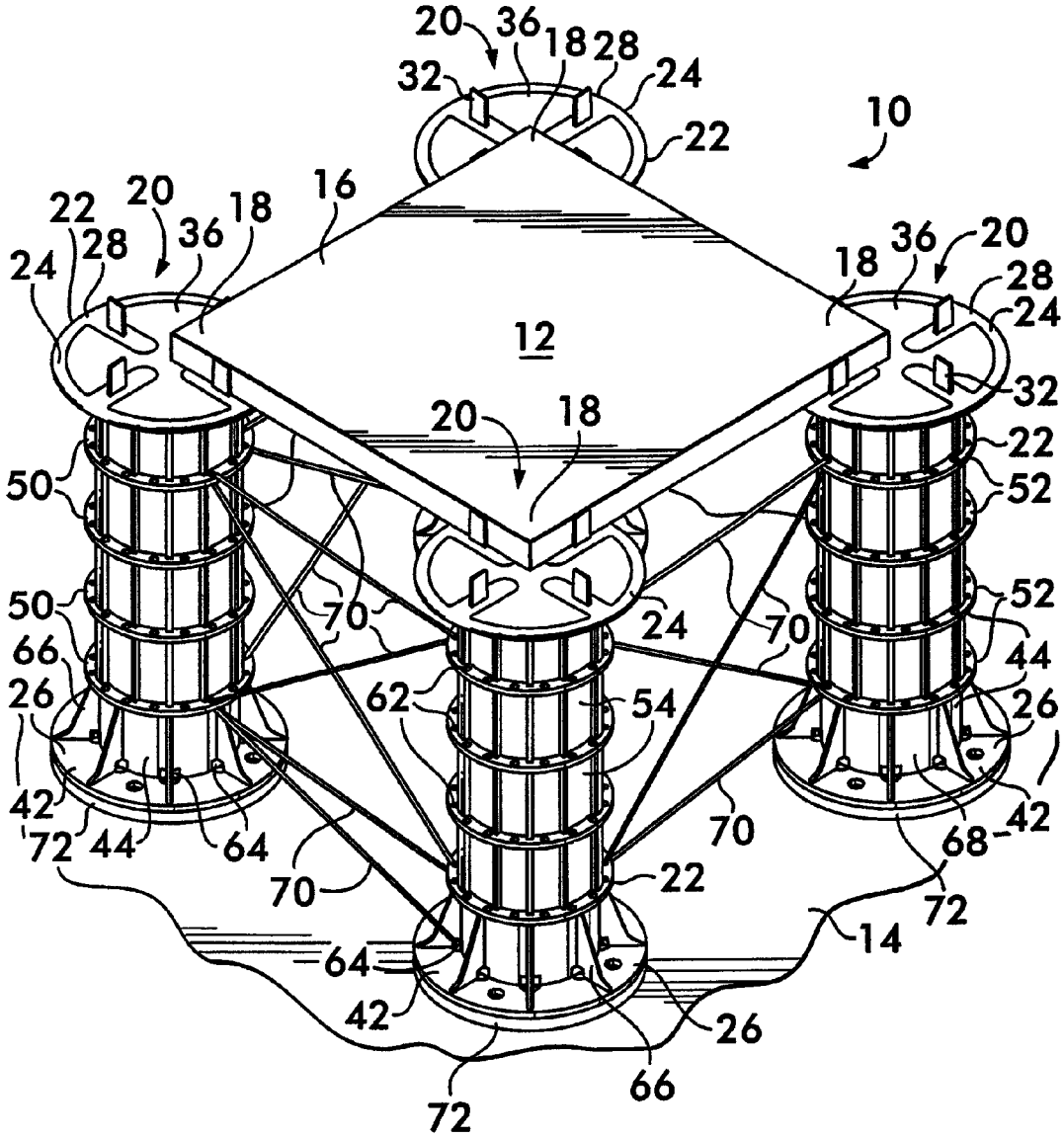
FIG. 4 is a perspective view of a part of a deck system having cross bracing between adjacent pedestals according to the present invention.

One or more couplers 50 can be assembled between the support 24 and base 26 to add further height to the pedestal 22. For example, FIGS. 1-3 show the use of a single coupler 50, whereas FIG. 4 shows the use of multiple couplers 50. Each coupler 50 is identical and separately manufactured from preferably the same plastic material as the support 24 and base 26.

Each coupler 50 includes a flange, or collar 52, from which a substantially cylindrical, hollow post 54 projects and a substantially cylindrical post 56 depends. In this configuration, the flange 52 extends circumferentially about a mid-section of the coupler 50 and extends laterally therefrom. Continuous or discontinuous spiral threads 58 are provided on an inner surface of the hollow post 54 and are capable of cooperatively engaging the threads 46 on post 30 of the support 24. In addition, continuous or discontinuous spiral threads 60 are provided on an outer surface of the hollow post 56 and are capable of cooperatively engaging the threads 48 on post 44 of the base 26. Accordingly, the coupler 50 can be used to interconnect the support 24 to the base 26. Further, the couplers 50 are designed to interconnect to each other so that multiple couplers 50 can be interconnected between the support 24 and the base 26. Rotation of the couplers 50, support 24, and base 26 relative to each other can be used to adjust the overall height "H" of the pedestal 22.

Preferably, the flange 52 of each coupler 50 extends in a plane that is substantially parallel to the support plate 28 and base plate 42. See FIG. 3. In the illustrated embodiments, the flange 52 is annular; however, it could be of any shape in plan. In addition, preferably, the support plate 28 is of a similar size, in plan, to that of the base plate 42. For example, both plates 28 and 42 can be provided in a circular shape, in plan, having substantially identical diameters. Alternatively, the plates, 28 and 42, and the flange 52 can be of different shapes and sizes.

The flange 52 preferably has a series of eyelets 62 extending therethrough. For instance, the eyelets 62 can be provided as apertures that are circumferentially spaced-apart about the mid-section of the coupler 50. In the illustrated embodiment, sixteen separate eyelets 62 are equally spaced-apart about the coupler 50. Fewer or more eyelets 62 can be provided on the annular flange 52. The eyelets 62 are used for securing the ends of bracing wires to the pedestal 22. The uniform distribution of closely-spaced eyelets 62 about the coupler ensures that an eyelet 62 will always be opposed to an eyelet 62 in an adjacent pedestal 22 thereby enabling ease of installation of the bracing. Thus, eyelets 62 should be readily available at most or substantially all locations about the coupler for ready coupling of bracing wires between pedestals. The bracing should not be required to be bent or the like due to the unavailability of eyelets and should not generate forces that may cause undesired rotation of any components of the pedestals 22.

The base 26 can also be provided with brace securement eyelets. For example, each base 26 can have a plurality of reinforcement walls 66 that extend radially-from an exterior 68 of the post 44. The walls 66 can be spaced-apart circumferentially about the post 44 and can extend integrally from both the plate 42 and post 44 of the base 26. Brace securement eyelets 64 can be provided in the walls 66. In the illustrated embodiment, the eyelets 64 are provided adjacent an area on the base 26 where the post 44 interconnects with the plate 42. As shown in FIG. 3, a plurality of drainage openings are formed in the plate 42 and extend into an inside of the hollow post 44. Each drainage opening is in communication with the eyelets 64.

The deck system according to the present invention can include cross bracing that ties adjacent pedestals 22 together and restrains their movement relative to one another. See FIG. 4. The bracing can include elongate wires, or rods, 70 that are secured to adjacent pedestals 22. The bracing 70 can extend substantially horizontal or can extend at angles to the horizontal. For instance, X-bracing patterns can be utilized. The ends of the bracing wires 70 can be crimped and secured to the eyelets, 62 and 64, of the pedestals 22, and the wires 70 can extend coupler-to-coupler using eyelets 62 or base-to-coupler using eyelets 62 and 64.

As stated above, a possible location of the deck 10 is on a sloped underlying surface, such as the sloped roof 14 of a building. Of course, the deck 10 can also be formed as a terrace, pedestrian walkway, plaza, sun deck, balcony, patio or any type of elevated flooring. Some surfaces, such as the roof surface 14, are provided at a slope for drainage or other purposes. In this case, levelers 72 (shown in phantom in FIG. 3) are used between the roof surface 14 and base plate 42 to ensure that the pedestal 22 projects substantially parallel to a vertical direction. As an example, the levelers 72 can be those disclosed in U.S. Pat. No. 5,442,882 issued to Repasky, the disclosure of which is herein incorporated by reference.

Accordingly, each base plate 42 of each pedestal 22 is seated within a recess of a level 72 that compensates for the slope angle of the roof so that the pedestals 22 can extend substantially parallel to a vertical direction thereby providing for ready formation of a horizontal deck surface 16.

It may be desired in some installations that the blocks 12 be mechanically tied to the pedestals 22. In this case, a corner cap 74 (shown in phantom in FIG. 3) can extend over the corner portions 18 of the blocks 12 within an intersection area 20 and be mechanically tied to the pedestal 22 with a fastener or the like. As an example, the caps 74 can be those disclosed in U.S. Pat. No. 6,604,330 B2 issued to Repasky, the disclosure of which is herein incorporated by reference.

The above-described deck system and pedestal assembly according to the present invention provides a stable elevated traffic bearing surface for pedestrians and the like on an existing structure, such as rooftop. The deck is easy to install and inexpensive to manufacture. The height of each pedestal can be adjusted by rotating the support relative to the base or by adding or subtracting couplers. Cross bracing can be installed coupler-to-coupler and base-to-coupler in a manner preventing unwanted rotation of various components of the pedestal assembly.

While a preferred ballast block deck system and pedestal assembly have been described in detail, various modifications, alterations, and changes may be made without departing from the spirit and scope of the ballast block deck system and pedestal assembly according to the present invention as defined in the appended claims.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A pedestal for supporting blocks, pavers, tiles, or panels a spaced distance above an underlying surface, comprising:

a base at a lower end thereof having a plate extending outward from a post;

a reinforcement wall extending between the plate and the post and having a first eyelet formed therein, the first eyelet is located at a corner where the post interconnects with the reinforcement wall;

a support at an upper end thereof for supporting the blocks, pavers, tiles, or panels thereon, the support being adjustably mounted relative to the base for altering an overall height of the pedestal;

a coupler being adjustably located between the support and the base for further altering the overall height of the pedestal;

a flange that extends circumferentially about the coupler; and, a plurality of spaced-apart second eyelets extending through the flange.

2. The pedestal of claim 1 wherein the first eyelet extends into a drainage opening of the base.

3. The pedestal of claim 1 wherein the post is hollow.

4. The pedestal of claim 3 further comprising drainage openings formed in the base.

5. The pedestal of claim 4 wherein at least one of the drainage openings is in communication with the first eyelet and an inside of the hollow post.

6. The pedestal of claim 1 further comprising a plurality of upstanding walls that project from a support plate of the support and that define quadrants on the support plate.

7. A pedestal system for supporting blocks, pavers, tiles, or panels a spaced distance above an underlying surface, comprising:

a plurality of pedestals each having a base; each base having a plate located on the underlying surface extending outward from a post, a reinforcement wall extending between the plate and the post, and a base eyelet located at a corner where the post interconnects with the reinforcement wall;

a support at an upper end of each pedestal for supporting the blocks, pavers, tiles, or panels thereon, the support being adjustably mounted relative to the base for altering an overall height of the pedestal;

couplers being adjustably located between the supports and the bases for further altering the overall height of the pedestals;

a flange extending circumferentially about each coupler;

a plurality of spaced-apart securement eyelets extending through each flange; and, wire bracing extending between the base and securement eyelets such the bracing spans an area extending downward from the couplers to the plates of the bases on the underlying surface.

8. The pedestal system of claim 7 wherein the base eyelet is located in the reinforcement wall.

9. A pedestal for supporting blocks, pavers, tiles, or panels a spaced distance above an underlying surface, comprising:

a base at a lower end thereof having a plate extending outward from a hollow post;

a reinforcement wall extending between the plate and the post and having a first eyelet formed therein;

a support at an upper end thereof for supporting the blocks, pavers, tiles, or panels thereon, the support being adjustably mounted relative to the base for altering an overall height of the pedestal;

a coupler being adjustably located between the support and the base for further altering the overall height of the pedestal;

a flange that extends circumferentially about the coupler;

a plurality of spaced-apart second eyelets extending through the flange; and drainage openings formed in the base, wherein at least one of the drainage openings is in communication with the first eyelet and an inside of the hollow post.

* * * * *